United States Patent [19]

Yoshizaki

[11] Patent Number: 4,617,880

[45] Date of Patent: Oct. 21, 1986

[54] VALVE ACTUATING APPARATUS FOR OPTIONALLY RESTING THE OPERATION OF A VALVE IN INTERNAL COMBUSTION ENGINE

[75] Inventor: Kouji Yoshizaki, Susono, Japan

[73] Assignee: Toyota Jidosha Kabushiki Kaisha, Aichi, Japan

[21] Appl. No.: 780,436

[22] Filed: Sep. 26, 1985

[30] Foreign Application Priority Data

Dec. 25, 1984 [JP] Japan ..... 59-195441

[51] Int. Cl.[4] ..... F02D 13/06

[52] U.S. Cl. ..... 123/90.16; 123/90.27; 123/90.39; 123/90.44; 123/198 F

[58] Field of Search ..... 123/198 F, 90.16, 90.15, 123/90.44, 90.39, 90.27

[56] References Cited

U.S. PATENT DOCUMENTS

| | | | |
|---|---|---|---|
| 4,151,817 | 5/1979 | Moeller | 123/90.16 |
| 4,203,397 | 5/1980 | Soeters | 123/90.16 |
| 4,204,512 | 5/1980 | Brock | 123/90.16 |
| 4,252,093 | 2/1981 | Hazelrigg | 123/90.16 |
| 4,380,219 | 4/1983 | Walsh | 123/90.16 |
| 4,387,680 | 6/1983 | Tsunetoni et al. | 123/198 F |
| 4,429,853 | 2/1984 | Chaffiotte et al. | 123/198 F |
| 4,537,164 | 8/1985 | Ajiki et al. | 123/90.16 |
| 4,537,165 | 8/1985 | Honda et al. | 123/90.16 |
| 4,556,025 | 12/1985 | Morita | 123/198 F |

FOREIGN PATENT DOCUMENTS

| | | |
|---|---|---|
| 57-193903 | 12/1982 | Japan . |
| 57-193904 | 12/1982 | Japan . |
| 59-67506 | 5/1984 | Japan . |
| 59-68109 | 5/1984 | Japan . |
| 59-226216 | 12/1984 | Japan . |

*Primary Examiner*—Ira S. Lazarus

*Attorney, Agent, or Firm*—Parkhurst & Oliff

[57] ABSTRACT

A valve actuating apparatus for intake and exhaust valves in an internal combustion engine having an end pivot type rocker arm. The rocker arm is composed of two arms interconnected by a connecting pin so as to be foldable. A lock pin selectively brings the rocker arm either into a single rigid rocker arm position or into a foldable rocker arm position at which it absorbs the lift of the cam to rest the operation of the valve, although the cam continues to rotate. A stopper is provided to restrict the returning position of the arms when folded toward the cam.

7 Claims, 6 Drawing Figures

VALVE ACTUATING APPARATUS FOR OPTIONALLY RESTING THE OPERATION OF A VALVE IN INTERNAL COMBUSTION ENGINE

BACKGROUND OF THE INVENTION

1. Field of the Invention

The present invention relates to a valve actuating apparatus for resting the operation of a valve such as intake and exhaust valves in an internal combustion engine. More particularly, it relates to a valve actuating apparatus which can render only a predetermined intake and/or exhaust valve or valves inoperative at a given engine condition.

2. Description of the Related Art

In a multi-cylinder internal combustion engine, it is known to selectively render only predetermined intake or exhaust valve(s) inoperative in order to cancel out the associated cylinder(s), thereby controlling the total displacement of the effective cylinders, in accordance with the engine load, resulting in the realization of a variable-cylinder internal combustion engine.

Among known valve actuating apparatuses of the kind mentioned above, those closest to the present invention are disclosed, for example, in Japanese Unexamined Utility Model Publication (Kokai) Nos. 59-68109 and 59-67506, in which a rocker arm is composed of two arm elements interconnected by a connecting pin so as to be foldable, with the outer ends of the respective arm elements engaged with the rocker shaft and the valve stem, respectivily. A further pin is secured on a stationary bracket and can be inserted into a hole arranged coaxially of the connecting pin. When the further pin secured on the stationary bracket is inserted in this hole, this pin provides a fixed pivot shaft about which only one arm element moves to operate the valve. When the further pin is removed from the hole, the rocker arm is foldable about the connecting pin to absorb the cam lift. In this prior art system, only one arm element extends between the valve stem and the connecting pin so as to have a length sufficient to actually operate the valve, and the other arm element is further extended from that sufficient length of the one arm element.

Japanese Utility Model Application Nos. 59-120916 and 59-153107, filed by the same assignee as for the present case, discloses a valve actuating apparatus for optionally resting the operation of a valve in an internal combustion engine, including a foldable rocker arm. This rocker arm comprises two arms rotatably interconnected by a connecting pin extending in parallel to a rocker shaft, and a lock pin which detachably interconnects the two arms. The connecting pin and the locking pin occupy separate positions from each other, so that the two arms are brought together as an integral rocker arm to operate the valve when the lock pin interconnects the two arms. The two arms are foldable at the connecting pin to absorb the lift of the cam and thus rest the operation of the valve.

In the rocker arm described above, when the rocker arm is in the foldable condition, it is folded down by contact with a cam nose portion of the cam, and returned to a generally straight original contour by a return spring when coming into contact with a base circle portion of the cam, this folding cycle being repeated. However, due to a tappet clearance normally provided in the intake or exhaust valve, there is a tendency for the rocker arm to be returned by the return spring beyond the above-mentioned generally straight original contour. The design of this apparatus is such that, upon the change from the foldable condition to the integral condition by the actuation of the lock pin, the lock pin can enter the corresponding cylinder to interconnect the two arms when the rocker arms assumes that generally straight original contour while it is in contact with the base circle portion of the cam. However, the rocker arm is returned to a point beyond this original contour, the lock pin may fail to enter the cylinder.

SUMMARY OF THE INVENTION

It is an object of the present invention to provide an improved valve actuating apparatus for optionally resting the operation of a valve in an internal combustion engine, which can obviate the above mentioned problems.

According to the present invention, there is provided a valve actuating apparatus for optionally resting the operation of a valve in an internal combustion engine having a swing rocker arm which is pivoted at its one end to a rocker arm shaft and at its other end bears against a valve stem of the valve, and a rotatable cam which bears against the rocker arm at an intermediate portion thereof to swing the latter about the rocker arm shaft, said apparatus being applied to said rocker arm which comprises: a first arm having one end pivoted to said rocker arm shaft and the other end extending toward said valve stem; a second arm having one end bearing against a valve stem and the other end extending toward said rocker arm shaft; a connecting pin carried by said two arms and extending in parallel to said rocker arm shaft for rotatably interconnecting the respective other ends of said two arms; a locking pin carried by one of said two arms and engageable with the other of said two arms to selectively interconnect said two arms, whereby said two arms are brought into a generally straight integral swing rocker arm position to operate the valve by following the cam when said locking pin interconnects said two arms and said two arms are foldable at said connecting pin by following the cam to rest the operation of the cam when said locking pin releases said two arms; and a stopper means to restict the returning position of said two arms when folded toward the cam.

Other features and objects of the invention will become apparent from the description given below.

BRIEF DESCRIPTION OF THE DRAWINGS

The invention will be described below in detail with reference to the accompanying drawings, which show preferred embodiments of the present invention, and in which.

DESCRIPTION OF THE PREFERRED EMBODIMENTS

Figure 1:
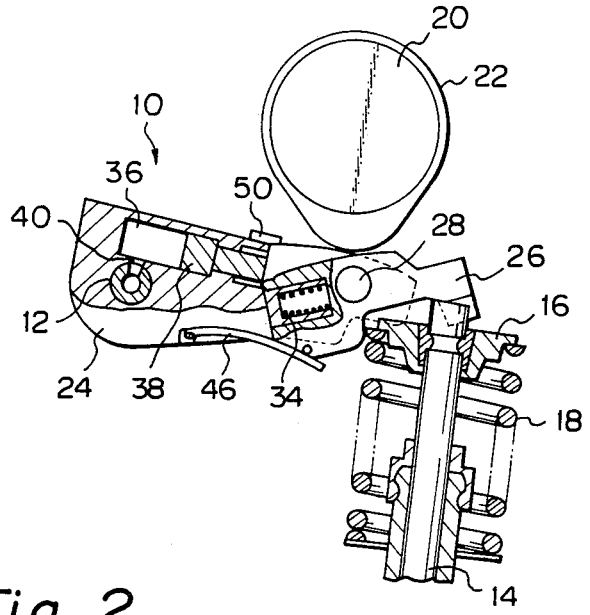
FIG. 1 is a partially sectioned side elevation of a valve actuating apparatus shown in an unlocked, i.e., inoperative position, according to the present invention.
Figure 2:
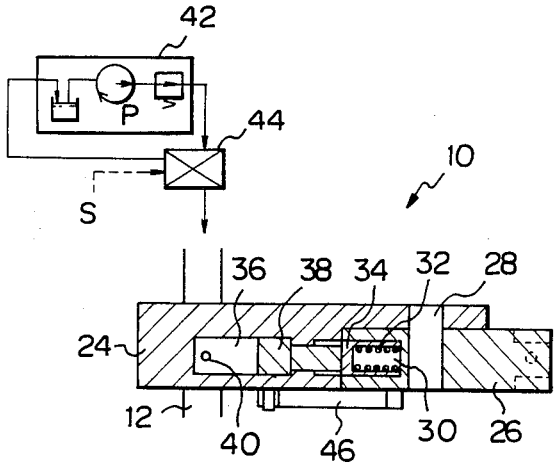
FIG. 2 is a horizontal section of FIG. 1 but in a different condition to that of FIG. 1.

FIGS. 1 and 2 show a first embodiment of the present invention, which is applied to a valve train in an internal combustion engine having an end pivot type swing rocker arm 10, which is pivoted at one end to a rocker arm shaft 12 and at the other end bears against the top of a valve stem 14 of a valve (not shown). The valve may be an intake or exhaust valve of the engine. As is well known, a valve retainer 16 is attached to the valve stem and a valve spring 18 is arranged between the valve retainer 16 and a cylinder head wall (not shown) so as to bias the valve to a closed position. A cam 22 is rigidly secured on a cam shaft 20 in a known rotatable manner and arranged to bear against the rocker arm 10 at an intermediate portion between both ends thereof, to swing the rocker arm about the rocker arm shaft 12.

The rocker arm 10, according to the present invention, is composed of two arms 24, 26. The first arm 24 has one end pivoted to the rocker arm shaft 12 and the other end extending toward the valve stem 14. The second arm 24 has one end bearing against the valve stem 14 and the other end extending toward th rocker arm shaft 12. These other ends of the both arms 24 and 25 are rotatably interconnected by a connecting pin 28, which is carried by and passes through the parallel extending ends of the arms 24 and 26. The connecting pin 28 extends in paralell to the rocker arm shaft 12, and allows relative rotation between the arms 24 and 25 about the connecting pin 28, but does not allow them to displace in a direction parallel to the connecting pin 28.

As shown in FIGS. 1 and 2, the first arm 24, pivoted to the rocker arm shaft 12, has a wider portion on the pivoted end side and a narrower portion on the free extreme side. Thus the two arms can slide against each other along the planar sliding surfaces extending perpendicular to the connecting pin 28 as well as generally cylindrical sliding surfaces around the connecting pin 28, defined at the free external end of the second arm 26 and the free external end of the wider portion of the first arm 24, respectively. A lock means is provided transversely of, or across, the sliding surfaces. In the first embodiment illustrated in FIGS. 1 and 2, the lock means is provided at the cylindrical sliding surfaces around the connecting pin 28. Alternately, in the third embodiment illustrated in FIGS. 5 and 6, the lock means is provided at the planar sliding surfaces extending perpendicular to the connecting pin 28.

In FIGS. 1 and 2, the lock means comprises a lock pin 34 which is lidably inserted in a cylinder 30 provided in the second arm 26 and biased toward the first arm 24 by a biasing spring 32. The lock means further comprises a cylinder 36 into which the lock pin 34 can be partially inserted to interconnect the two arms 24 and 26 when the two cylinders 30 and 36 are aligned. A stepped piston 38 is fitted in the cylinder 36 in the first arm 24. The cylinder 36 has a step to receive the stepped piston 38, so that the front surface of the piston 38 reaches and constitutes a part of the sliding surface as above stated when it is advanced. A hydraulic oil is introduced in the cylinder 36 behind the piston 38 through a channel 40 communicating with an oil passage defined by the hollow rocker arm shaft 12. The pressurised oil can be fed from a source of the pressurised oil 42 through a solenoid-operated valve 44, which can be controlled by a signal S representative of th engine load and speed. Further, an arm return spring 46 is provided between the two arms 24 and 26 to return the rocker arm 10 toward the cam 22 to maintain the rocker arm 10 in contact with the cam 22 while the rocker arm 10 is folded about the connecting pin 28, as will be described hereafter.

FIG. 1 shows that the cam 22 bears at its cam nose portion against the rocker arm 10, and that the lock pin 34 is retracted from the cylinder 36 of the first arm 24 by introducing the pressurised oil into the cylinder so as to advance the piston 38 and force out the lock pin 34. As the cam 22 rotates from this position toward its base circle portion, the two arms 24 and 25 are returned toward the cam 22 by the return spring 46 to a position where at the two arms 24 and 26 define a generally straight rocker arm contour. At this position wherein the base circle portion of the cam 22 engages with the rocker arm 10, or the first arm 24, or even the second arm 26, the upward movement of the first arm 24 is restricted by the cam 22. However, the second arm 26 may further move until the outer end of the second arm 26 abuts against the valve stem 14. Note that a certain tappet clearance is provided between the valve stem 14 and the second rocker arm 26. This means that the tappet clearance is cancelled if the two arms are interlocked at this overturned position.

According to the present invention, a stopper 50 is fixedly secured to the first arm 24 at its top surface facing the cam 22 so that the stopper 50 can engage the second arm 26 to restrict the returning position of the rocker arm 10 toward the cam 22, with the rocker arm 10 engaged with the base circle portion of the cam. Thus the tappet clearance is ensured. The arrangement is so designed that the lock pin 34 aligns the piston 38, and thus the cylinder 36, when the second arm 26 engages with the stopper 50. Accordingly, the change between the valve operable condition and the valve resting condition is effected by the actuation of the lock pin 34 when the base circle portion of the cam 22 engages with the rocker arm 10 and the second arm 26 engages with the stopper 50 with the tappet clearance maintained.

The operation of the valve actuating apparatus for optionaly resting the operation of the valve will now be described.

The cam 22 continues to rotate synchronously with the engine. When the operation of the valve is to be rested or the valve is to be rendered inoperative for cancelling out one or several cylinder(s) in the multicylinder engine, or for resting one of the multiple intake (exhaust) valves in one cylinder, the control unit (not shown) controls the solenoid-operated valve 44 into an open position and the pressurised oil from the source 42 is introduced into the cylinder 36. The hydraulic oil then exerts pressure on the piston 38 which forces the lock pin 34 out of the cylinder 36 and the front surface of which reaches the adjoining sliding surfaces of the arms 24 and 26. At this stage, the lock pin 34 releases the interlock between the two arms 24 and 26, and the arms 24 and 26 become rotatable about the connecting pin 28. In this condition, the rocker arm 10 is foldable by following th cam 22, which exerts a downward pressure on one or both of the arms 24 and 26, because both ends of the rocker arm 10 are supported by the rocker arm shaft 12 and the valve stem 14 and the spring force of the valve return spring 18 is greater than that of the arm return spring 46. Thus the external end of the second arm 26 does not depress the valve stem 14 and the normal rotation movement of the cam 22 is not transferred to the valve stem 14 but absorbed by the folding rocker arm 10. In this way, the operation of the valve is rested and the valve is maintained in a closed position. The arms 24 and 26 repeat the bending motion by following the motion of the cam 22 and the arm return spring 46, with the external end of the second arm 26 bearing against the top surface of the valve stem 14. The second arm 26, as stated previously, abuts against the stopper 50 to maintain the tappet clearance and to align the lock pin 34 with the cylinder 36 while the rocker arm 10 engages with the base circle portion of the cam 22.

When the engine condition changes, for example, the engine load becomes greater, the intake (exhaust) valve is to be returned to the operation state by controlling the solenoid-operated valve to a closed position so as to release the pressure in the cylinder 36. Then the spring force of the bias spring 32 in the cylinder 30 overcomes the pressure in the corresponding cylinder 36, with the result that the lock pin 34 partially enters the facing cylinder 36 to interlock the two arms 24 and 26 while the rocker arm 10 engages with the base circle portion of the cam 22. Thus the two arms 24 and 26 are interconnected at two separate positions by the connecting pin 28 and the lock pin 34, and the two arms 24 and 26 now cannot rotate or fold at the connecting pin 28. In this way, the two arms 24 and 26 are brought into a single generally straight integral rocker arm 10 condition. In this condition, the motion of the cam 22 is transferred to the valve stem 14 through the rigid rocker arm 10 to operate the valve, which opens or closes synchronously with the engine.

Figure 3:
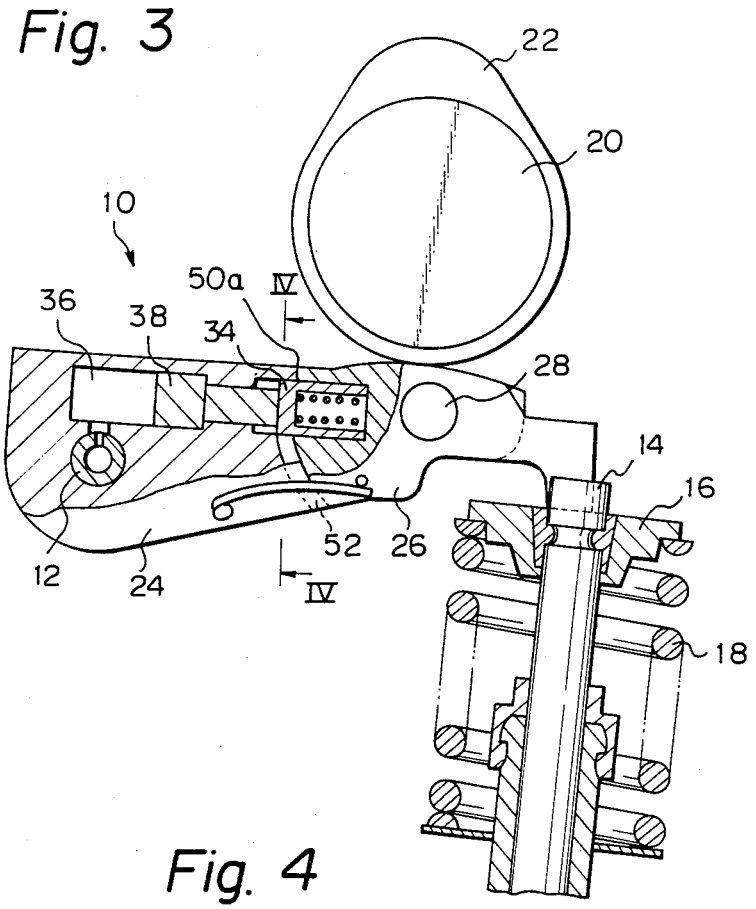
FIG. 3 is a partially sectioned side elevation of a valve actuating apparatus according to a second embodiment of the present invention.
Figure 4:
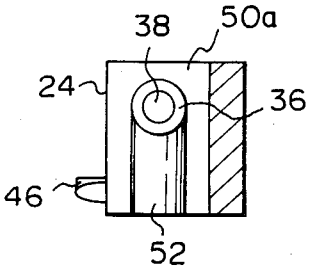
FIG. 4 is an end view of one of the arms shown in FIG. 3.

FIGS. 3 and 4 illustrates the second embodiment of the present invention. Similar elements to those in FIGS. 1 and 2 are represented by identical reference numerals, so that, for simplicity, a description regarding such similar parts is omitted. In this embodiment, the arrangement of the stopper is modified from the first embodiment. As stated previously, the rocker arm 10 has cylindrical sliding surfaces around the connecting pin 28, and the lock means is provided across those sliding surfaces. One of the sliding surfaces, namely, the front surface of the wider portion of the first arm 24, has an opening for the cylinder 36 and a guide groove 52 along which the lock pin 34 is guided during the above-described foldable condition. The guide groove 52 terminates at a wall 50*a*, which also defines the cylinder 36. The piston 38 reaches the bottom of the guide groove 52 at its most advanced position. It will be clear that the wall 50*a* constitutes a stopper to restrict the returning position of the rocker arm 10 toward the cam 22.

Figure 5:
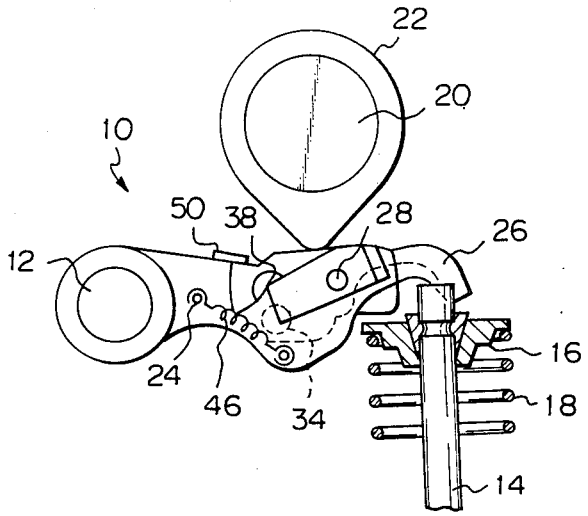
FIG. 5 is a side elevation of a valve actuating apparatus according to a third embodiment of the present invention.
Figure 6:
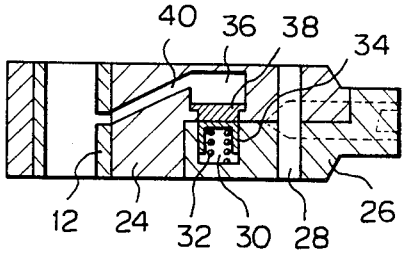
FIG. 6 is a horizontal section of FIG. 5 but in a different condition to that of FIG. 5.

FIGS. 5 and 6 illustrate the third embodiment of the present invention. This example is also similar to the first embodiment, except in the arrangement of the lock means and an arm return spring 46. In this embodiment, the lock means is provided across the planar sliding surfaces perpendicular to the connecting pin 28 and comprises the similar lock pin 34 and piston 38 inserted in the respective cylinders 30 and 36 which extend in parallel to the connecting pin 28. An arm return spring 46 in FIG. 5 is a coil spring, but an arm return spring 46 in FIG. 1 is a torsinal spring.

As described above, it is possible to obtain, according to the present invention, a valve actuating apparatus for optionally resting the operation of a valve in an internal combustion engine, which can reliably change the valve operating conditions, in which the tappet clearance is maintained, and a lock pin can be aligned with a counter cylinder for the lock pin to be inserted therein by means ot a stopper when the rocker arm engages with the base circle portion of the cam.

I claim:

1. A valve actuating apparatus for optionally resting the operation of a valve in an internal combustion engine having a swing rocker arm which is pivoted at one end to a rocker arm shaft and at the other end bears against a valve stem of the valve, and a rotatable cam which bears against the rocker arm at an intermediate portion thereof to swing the latter about the rocker arm shaft, said apparatus being applied to said rocker arm which comprises:

a first arm having one end pivoted to said rocker arm shaft and the other end extending toward said valve stem;

a second arm having one end bearing against a valve stem and the other end extending toward said rocker arm shaft;

a connecting pin carried by said two arms and extending in parallel to said rocker arm shaft for rotatably interconnecting the respective other ends of said two arms;

a locking pin carried by one of said two arms and engageable with the other of said two arms to selectively interconnect said two arms, whereby said two arms are brought into a generally straight integral swing rocker arm position to operate the valve by following the cam when said locking pin interconnects said two arms, and said two arms are foldable at said connecting pin by following the cam to rest the operation of the valve when said locking pin releases said two arms; and a stopper means to restrict the returning position of said two arms when folded toward the cam.

2. An apparatus according to claim 1, wherein said two arms are biased by a spring toward the cam.

3. An apparatus according to claim 2, wherein said two arms have cooperating sliding surfaces, and wherein said locking pin is slidably inserted in a cylinder provided in one of said two arms transversely of said sliding surfaces and can be further slidably inserted in a corresponding cylinder provided in the other of said two arms.

4. An apparatus according to claim 3, wherein said locking pin is hydraulically operated.

5. An apparatus according to claim 4, wherein said stopper means is fixedly secured on one of said arms at a top surface facing to the cam to cooperate with a corresponding top surface of the other arm.

6. An apparatus according to claim 4, wherein said stopper means is provided on the sliding surface of said other of said two arms to cooperate with said locking pin.

7. An apparatus according to claim 6, wherein said sliding surface of said other of said two arms has a groove to guide said lock pin when folded, said groove terminating at or adjacent to an opening of said cylinder provided thereon to further slidably receive said lock pin, a wall defining the termination of said groove constituting said stopper means.

* * * * *